United States Patent [19]

Cahn et al.

[11] 3,998,695

[45] Dec. 21, 1976

[54] ENERGY STORAGE BY MEANS OF LOW VAPOR PRESSURE ORGANIC HEAT RETENTION MATERIALS KEPT AT ATMOSPHERIC PRESSURE

[76] Inventors: Robert P. Cahn, 799 Ridgewood Road, Millburn, N.J. 07041; Edward W. Nicholson, 18 Devon Road, Summit, N.J. 07901

[22] Filed: Dec. 16, 1974

[21] Appl. No.: 533,263

[52] U.S. Cl. ..... 176/39; 176/60; 176/65; 60/644; 60/659

[51] Int. Cl.[2] ..... G21C 15/16

[58] Field of Search ..... 176/37, 60, 65; 60/644, 60/659

[56] References Cited

UNITED STATES PATENTS

| | | | |
|---|---|---|---|
| 3,065,162 | 11/1962 | Hub | 60/644 |
| 3,304,233 | 2/1967 | Kelso | 176/39 |
| 3,457,725 | 7/1969 | Schwarzenbach | 60/659 X |
| 3,558,047 | 1/1971 | Nuernberg et al. | 176/39 X |
| 3,681,920 | 8/1972 | Margen | 60/652 |
| 3,724,212 | 4/1973 | Bell | 60/644 |
| 3,848,416 | 11/1974 | Bundy | 60/644 |
| 3,890,789 | 6/1975 | Beckmann et al. | 60/659 |

OTHER PUBLICATIONS

Adjustment of Power – – – Heat, Transactions of the American Nuclear Society, P. Pacault & J. Tillequin, European Nuclear Conf., Paris, France, Apr. 21–25, 1975.

*Primary Examiner*—Samuel W. Engle
*Assistant Examiner*—Peter A. Nelson
*Attorney, Agent, or Firm*—J. J. Allocca

[57] ABSTRACT

The power output from a nuclear power plant or fossil fuel power plant operating under constant reactor (or furnace) and boiler conditions is varied by increasing the turbine extraction steam during low power demand periods for the purpose of using the steam to heat a low vapor pressure organic material and storing such low vapor pressure organic material under atmospheric pressure at high temperature. During periods of high power demand, the extraction rate from the steam turbine is decreased or even discontinued and the stored hot low vapor pressure organic material is used for boiler feed water preheat and interstage steam reheat.

8 Claims, 1 Drawing Figure

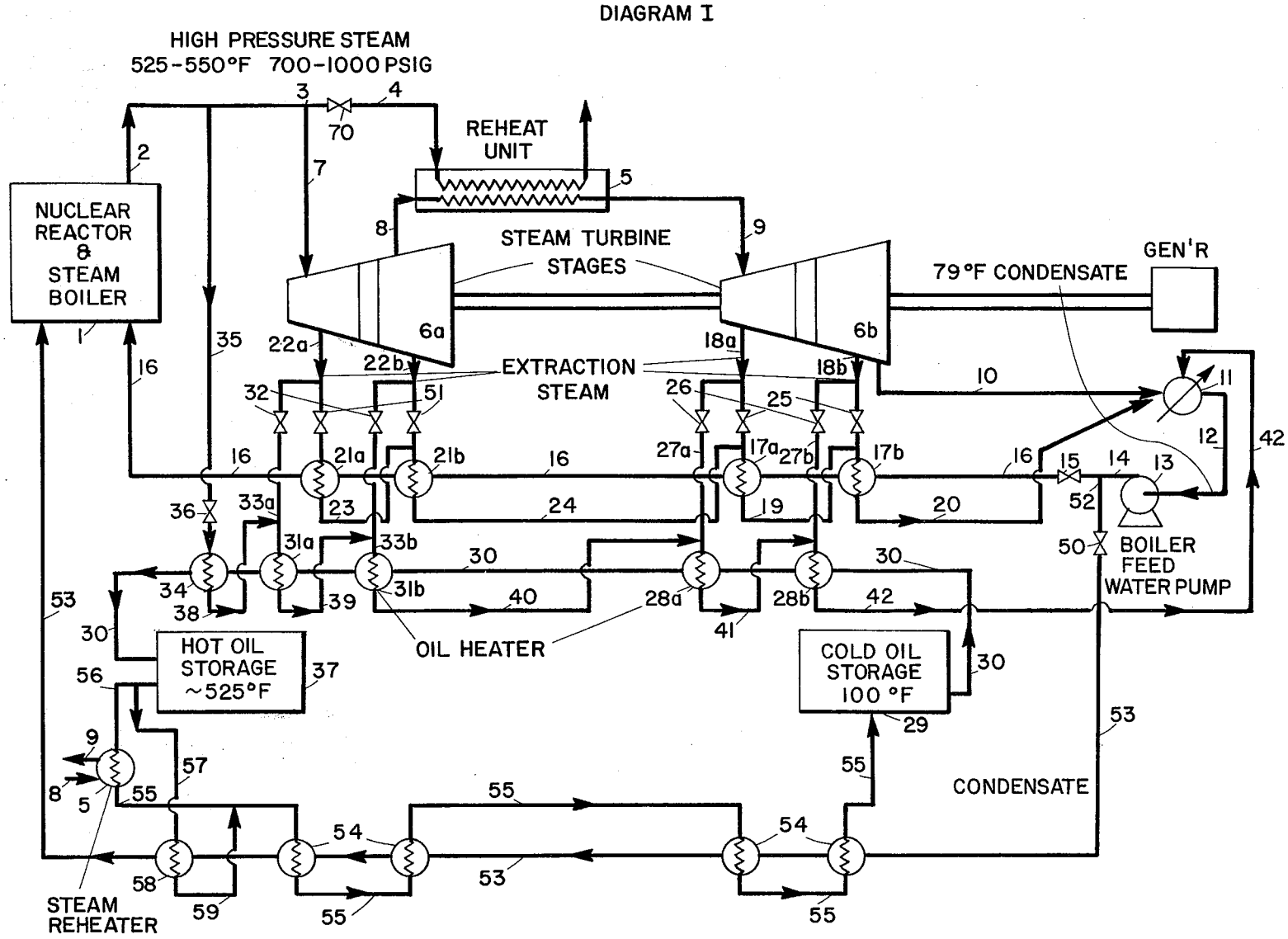
DIAGRAM I
HIGH PRESSURE STEAM
525-550°F 700-1000 PSIG
REHEAT UNIT
STEAM TURBINE STAGES
EXTRACTION STEAM
GEN'R
79°F CONDENSATE
BOILER FEED WATER PUMP
CONDENSATE
COLD OIL STORAGE 100°F
OIL HEATER
HOT OIL STORAGE ~525°F
NUCLEAR REACTOR & STEAM BOILER
STEAM REHEATER

ENERGY STORAGE BY MEANS OF LOW VAPOR PRESSURE ORGANIC HEAT RETENTION MATERIALS KEPT AT ATMOSPHERIC PRESSURE

The typical nuclear powered electric generation plant consists of essentially two distinct sections. The heart of the plant is the nuclear reactor, the source of the heat used to generate the steam in the boiler utilized by the turbines and generators. The nuclear reactor and steam boiler represent about 75% of the total investment in nuclear powered electric generating stations and are limited in the degree of flexibility they can exhibit. The steam turbines, condensers, generators, fittings and general electrical facilities represent the remaining 25% of the total investment, are strictly conventional in design and operation and are, further, capable of operation over relatively wide variation of parameters.

There are many practical objections to throttling the output of a nuclear reactor. A reactor is most efficient when operating at maximum potential. Periodically reducing the output of the reactor reduces the efficiency, increases operating difficulties and hazards and increases the costs of running the plant. This inherent inflexibility of nuclear plants means that they can only be utilized as "base load" plants and that the intermediate load and peak-shaving service have to be met by conventional fossil fuel fired generators (coal or oil-burning boilers or gas turbines, etc.). The expensive nuclear heart of the nuclear powered generation plant is incapable of following load demands and, therefore, a large part of the total daily power requirements are not met by the nuclear plants.

The instant invention relates to a novel way in which, during periods of low power demand, the excess heat output of a steady state nuclear reactor can be stored in low vapor pressure organic material at atmospheric pressure for use during peak demand periods as boiler feed water and interstage steam reheating materials. Cold LVP organic heat retention material preferably stored at a temperature of about 100° F is heated to a temperature preferably of about 525° F. The invention allows operating the reactor and boiler at maximum steady conditions while the turbines, generators and electrical facilities can fluctuate between about 75–120% of a base load of 100%. If this 75% is considered the new base load, the nuclear plant will now have a capacity of 60% of base load to peak load following capacity and while operating continuously at maximum efficiency, the plant will be able to utilize the flexibility of the conventional electrical generation apparatus.

The present invention is also applicable to modern fossil fuel plants, particularly those incorporating pollution abatement provisions either in the form of fuel gas preparation or flue gas scrubbing facilities. Since such facilities are very expensive, they, similar to nuclear reactors, force the utility to operate such plants all out as base load stations. Any provision to permit them to follow the load would extend the use of such plants into the intermediate and even peak shaving load ranges.

This invention offers the further advantage of rapid response to demand. The unit can follow the load by adjusting the steam rate to and from the turbine by regulating the amount of preheat and reheat done by extraction steam and the amount of preheat and reheat done by hot thermal energy retention material. Therefore, the present invention must be considered as making totally available the spinning reserve up to the maximum capacity of the turbine-generator combination.

The prior art demonstrates numerous instances in which more efficient utilization of energy by various means and by various types of machinery was sought. British Patent 381,924 (Oct. 10, 1932) discloses a method for varying the performance of a steam engine (turbine) by increasing or decreasing the preliminary heating of the feed water by tapping the steam stream utilized by the turbine. The preliminary heating of the feed water is controlled in relation to the condition of the load on the subordinate engine giving off the preheating steam. It is possible by this invention to tap the main steam line and either store high temperature water to preheat feed water or to itself serve as hot feed water, or to bleed steam from the turbine exhausts and directly heat the feed water. In this way, it is possible to regulate the performance of the steam engine and, more efficiently utilize the fuel burned to supply the heat. At periods of low power demand, boiler feed water is either drawn from a storage tank of cold water and a steam side stream is drawn from the turbine and used to heat the feed water. At periods of high power demand, hot stored water is fed to the boiler and no steam is drawn off from the turbine, all available steam going for the production of power. The performance of the turbine, therefore, is controlled by the amount of steam bled from the turbine in accordance with power demand requirements. This system is different from the instant invention in that British Pat. No. 381,924 uses water as a heat storage medium. It does not teach a method of storing large quantities of thermal energy for use during peak power demand periods. The hot feed water, according to the patent, is stored in the same container as the cold condensate, the cold water merely being in the bottom portion of the tank while the hot is at the top. Even if separate tanks were utilized, to achieve efficiency in heat storage, high temperature and very high pressure water storage would be necessary.

U.S. Pat. No. 3,681,920 discloses a power plant operating with a varying production of electric power and coupled into an evaporation apparatus. When the plant is operating at low energy production, excess thermal energy is stored in the form of hot water. When the plant is generating peak electric power, the stored hot water is used to run the evaporation apparatus. In this way, relatively uniform and continuous utilization of the evaporator can be achieved through all phases of plant operations. It is readily seen from the above, that this patent is in no way concerned with energy storage for the purpose of meeting energy production demand fluctuation requirements. Further, the heat storage system utilized is high temperature water, which of necessity, would require high pressure storage apparatus for efficient energy containment. If no such pressure equipment is used, the water can only be stored to a maximum of 99° C at atmospheric pressures which means that only a small portion of the potentially available heat energy can be stored.

U.S. Pat. No. 3,166,910 discloses an apparatus for the control of a steam power plant. The invention relates to a system in which steam is tapped from the turbine for preheating the feed water and two vessels are provided, one for cold water storage and one for hot water storage. At periods of low energy demand, cold water is drawn from the cold water tank and preheated by steam bled from the turbine. During this period, hot water is stored in the hot water tank. To be efficient, such hot water must be stored under pressure or else temperatures of only up to about 99° C can be utilized. When power demands are high the cold water flow is stopped, no steam is bled from the turbine and hot water is drawn from the hot water tank as feed water. The hot water is not utilized to preheat feed water but is itself used as the hot feed water.

U.S. Pat. No. 3,129,564 deals with forced flow steam generating plants including a reheat apparatus. This system features a storage unit which accumulates hot water during periods of low power demand and feeds out such water as preheated boiler feed water during periods of high power demand. During peak demand, no steam is drawn from the turbine and the accumulated hot water is used as feed water itself and not as feed water heating material. During low demand, steam is used to preheat BFW (boiler feed water) and hot water is stored to meet anticipated demands.

It is clear from all of the above, that efficient energy storage can be achieved only at high pressure. Storage costs skyrocket when pressure is required. 500° F water means 700 PSI pressure, an uneconomical situation if storage of large quantities of potential power is desired. Storing hot water under pressure in underground caverns, which is being considered as a means of pressurized storage of air, is fraught with problems such as dissolution of minerals and fouling of heat exchangers and machinery.

Where a multi-stage steam turbine receives a given amount of high pressure steam, maximum power is obtained from this steam when all the steam is allowed to expand through all the turbine stages and is condensed at the "thermal sink" temperature in the condenser. However, the boiler then has to reheat the cold boiler feed water and evaporate the hot water at boiler pressure and temperature, and this is a waste of high level heat. It is much more economical to extract varying amounts of interstage intermediate pressure steam streams from the turbines in amounts and at pressure levels commensurate with the boiler feed water preheat requirements. In this way, various streams which have already done some work in the high pressure stages of the turbine are used to preheat the boiler feed water gradually, and for each Btu of intermediate pressure steam used for this preheat service (after some work was obtained from it) a Btu of high level heat is freed from preheat service and made available to generate high pressure steam for the turbine. Consequently, maximum power from a given capacity boiler plus turbine can be obtained if judicious amounts of intermediate pressure steam streams are extracted from between the various stages of the turbine and used for boiler feed water preheat. The exact levels of pressure and temperature, and the amounts of such streams, may vary from about 2–10% of the total steam at each extraction point and are at the discretion of the designers.

Generally, the high temperature, high pressure steam coming directly from the boiler is not used for boiler feed water preheat since there is no advantage in such a "boot-strap" operation. High level heat would be used, before any work was extracted from it, to save high level heat. However, some of this high pressure steam is used for the purpose of reheating intermediate pressure turbine interstage steam. This, in effect, superheats this intermediate pressure steam so as to minimize the degree of condensation occurring in the turbine during the subsequent adiabatic expansion.

The instant invention makes use of the above principles, regarding high pressure steam extraction, steam boiler feed water preheat and interstage steam reheat to allow storage of heat to the maximum extent and use of this stored heat at the appropriate time to maximize the power output from a given plant.

Steam turbines are very flexible and can be operated at partial load. A turbine driving a generator can follow the electrical load by varying not only the amount of high pressure steam being fed to it, but also the fraction of steam extracted interstage from it. Using this principle, it is now possible to use, during periods of low load, extraction steam at different pressure levels, as well as high pressure steam to heat a low vapor pressure heat storage medium, such as a hydrocarbon oil, to a temperature level close to that of the boiler. For example, if the boiler operates at 550° F and produces steam at about 1050 psi, the oil can be heated to about 520°–535° F. It should be noted that since this oil heating is achieved by means of extraction, as well as high pressure steam, it is thermodynamically as efficient as the boiler feed water preheating scheme outlined above. In addition, this permits a given power plant to operate steadily at maximum fuel burning capacity-efficiency (nuclear or fossil) but with a drop in power output dependent on the amounts of high pressure and extraction steam diverted to oil heating service. The loss in power output, however, represents no loss in thermal efficiency, since the heat not used to generate electrical power is stored in a form which can be easily and efficiently recalled from storage. During periods of low load, steam extraction is maximized, oil heaing is maximized and power output is minimized, without affecting the operating rate of the reactor, the feed water temperature or steam rate of the boiler. During periods of high-load, withdrawal of high pressure steam and extraction of intermediate pressure steam can be curtailed or discontinued with a consequential increase in turbine performance, but with no loss in thermodynamic efficiency in the reactor or boiler as would occur if the boiler feed water temperatures were lowered. During this period, power plant support heating functions occurring in heat exchangers are assumed by the hot oil. Feed water preheating and interstage steam reheating is simply done by means of the heat stored in the oil. Power plant support heating functions occurring in heat exchangers as used in this specification means those heating operations other than raising primary live steam in the boiler.

By using this concept, it has been calculated that, by storing about 25–35% of the heat output of a nuclear plant, or modern fossil fuel furnace, about 15–20% of the power output of such a plant can be shifted from low-load to high-load periods. Thus, a nuclear plant operating at 1015 psi and 545° F, and generating a designed rate of 1000 MWe (megawatts electrical) can be made to drop its power output to about 750–800 MWe during low load periods and increase its output to 1150–1200 MWe during high load periods, without any variation in nuclear reactor or boiler operation. The plant was designed to generate 1000 MWe utilizing some high pressure steam for interstage steam reheat and extraction steam for boiler feed water preheat. By using the hot low vapor pressure organic material to reheat steam and preheat feed water, all steam generated can be sent to and fully utilized in the turbine with an accompanying increase in performance at that point. Overall thermodynamic efficiency is retained since the boiler feed water is still being heated to an efficient temperature before introduction into the boiler, said temperature being the same as during the low-load period of plant operation.

Hydrocarbon oils with good heat transfer properties are excellent for temperatures below about 650° F if kept isolated from the atmosphere to prevent oxidation. Such materials as heavy hydrocarbon oils will have a satisfactory low vapor pressure at the maximum temperature, allowing convenient storage in atmospheric pressure tankage. Consequently, thermal energy up to about 600°–650° F bulk temperatures can be stored at atmospheric pressure in a hydrocarbon oil or similar organic material such as aromatic ethers or oxides at such temperatures.

BRIEF DESCRIPTION OF THE DRAWING

A better understanding of the envisioned embodiments of the above invention can be gathered by reference to the accompanying drawing. Diagram I describes a conventional plant with boiler operations designed to run on BFW preheated to about 320° F.

Diagram I — High pressure steam comes from the nuclear reactor and steam boiler 1 and passes through conduit 2. At fitting 3, some high pressure steam is shunted through conduit 4 to be used as the heating medium in an interstage steam reheat unit 5. The major portion of the steam is fed to the turbines 6*a* through conduit 7, and proceeds for reheating through conduit 8 to the steam reheat unit 5. This motive steam is then led in series by conduit 9 to low pressure turbine 6*b*. Spent steam from 6*b* goes through conduit 10 to condenser 11. In a plant operating without benefit of the instant invention, the condensate from 11 moves through conduit 12 to pump 13 where it is introduced to conduit 14. Conduit 14 leads to a series of heat exchangers. The cold condensate in conduit 14 is led through valve 15 to conduit 16 where it is introduced to heat exchangers 17 *a*and *b*. Heat exchangers 17 *a* and *b* are heated by extraction steam from low pressure turbine 6*b* led through conduits 18 *a* and *b*. Extraction steam condensate from 17*a* passes through conduit 19 to 17*b* where additional heat is exchanged and thence through conduit 20 to condenser 11. The now moderately warmed boiler feed water in conduit 16 passes through heat exchangers 21 *a* and *b* wherein extraction steam from high pressure turbine 6*a* led through conduits 22 *a* and *b* is used to heat the water. Here steam condensate from exchanger 21*a* passes through conduit 23 to exchanger 21*b* and from 21*b* through conduit 24 to exchanger 17*a* and from there through the series of exchangers as previously described. The now preheated boiler feed water in conduit 16 is fed into the boiler 1.

The novel aspect of the instant invention is as follows. In addition to the above standard boiler feed water system an energy storage process is utilized which can work in conjunction with the standard method or, and this is a major advantage of the system, entirely replace conventional boiler feed water heating processes during periods of peak demand. Again referring to Diagram I:

During periods of low demand, boiler feed water is preheated as described above, but further, extraction steam from the turbines, some high pressure steam from the boiler, and the condensates from the various extraction steam condensers are also being used to heat the low vapor pressure organic material. Extraction steam from turbine 6*b* passes through conduits 18 *a* and *b*. Valves 25 and 26 are open allowing steam to both preheat boiler feed water as described above and to allow steam to pass through valves 26 through conduits 27 *a* and *b* to heat exchangers 28 *a* and *b* where cold oil from vessel 29 passing through conduit 30 gains thermal energy. The heated oil continues along conduit 30 to heat exchangers 31 *a* and *b*, where steam from turbine 6*a* passing through conduits 22 *a* and *b* and through valves 32 and along conduits 33 *a* and *b*, is used to further increase the temperature of the oil before it is passed to heat exchanger 34 where primary high pressure steam from the reactor and boiler 1 passing through conduit 2 down conduit 35 and through valve 36 is used to impart a final measure of thermal energy before the hot oil is stored in vessel 37. The expended high pressure steam condensate from 34 passes through conduit 38 to heat exchanger 31*a* where it imparts energy to the oil and then this steam condensate plus additional condensate from 31*a* passes through conduit 39 to exchanger 31*b* where cooler oil gains more energy from the steam and condensate. This process of progressively heating cooler oil coming through conduit 30 by using both extraction steam and higher pressure steam condensate continues as steam condensate moves from unit 31 through conduit 40 to unit 28*a* and thence through conduit 41 to unit 28*b*. This steam condensate is then conducted through conduit 42 to condenser 11.

The amount of boiler feed water moving through conduit 14 is fixed. However, the split of this stream between conduits 16 and 53 is determined by regulation of valves 15 and 50. During periods of peak demand, valve 15 is closed, shutting flow through conduit 16. Valves 70, 51 and 25 are also shut to heat exchangers 5, 21*a* and *b*, and 17 *a* and *b*. Further, valves 32 and 26 are also shut, terminating steam flow to oil exchangers 31 *a* and *b*, and 28 *a* and *b*. Valve 36 on conduit 35 to exchanger 34 is also closed. Boiler feed water from the condenser 11 now passes through conduit 12 to pump 13 through conduit 14 to conduit 52 and through valve 50 to conduit 53. Conduit 53 passes through a series of heat exchangers. Cold BFW in conduit 53 contacts exchangers 54 where it gains heat from oil passing through conduit 55. The oil in conduit 55 comes from storage vessel 37. The hot oil from 37 passes through conduit 56 initially to the interstage steam reheat unit 5 where its initial high temperature is most effectively utilized. As the oil cools down, it moves through conduit 55 and is contacted countercurrently with progressively cooler BFW in numerous heat exchangers 54. Some hot oil coming initially out of the storage tank may be used directly to heat boiler feed water without first partially expending itself as interstage steam reheat material by passing through conduit 57 to heat exchanger 58 where BFW is given its final thermal boost before introduction into the boiler. This hot oil then moves through conduit 59 to conduit 55. The above scheme can be used as described, or can be used with both conventional and novel systems operating simultaneously, that is, with boiler feed water being heated along both conduit 16 and conduit 53. However, by shutting down conduit 16 and all valves numbered 51, 32, 70, 25, 26 and 36, all boiler feed water preheat and interstage steam reheat operations are carried out using stored energy and all steam produced is channeled to the turbines enabling the plant to achieve a high level of power output without affecting BFW temperature, BFW rate and boiler performance.

It should be noted that the feed water preheat and intermediate steam reheat with oil, as shown in exchangers 5, 58 and 54 may be in place of as well as in addition to exchanger units which perform a similar duty with high pressure steam, extraction steam and condensate streams, that is exchangers 21 *a* and *b*, 17 *a* and *b*, and 5. It is therefore completely within the scope of this invention to carry out the reheating and preheating duties with circulating hot oil at all times and only vary the amount of oil reheat being done at any given time as a function of the power load. Maximum reheat would occur at low demand, minimum or no reheat during high demand periods.

It must be emphasized that the precise heat exchange sequence, numbers of exchangers and extent of steam extraction, preheat and reheat are variables which are at the discretion of the designer. The above flow plan is only one typical sequence which can easily be modified by those skilled in the art without departing from the concept of the present invention.

What is claimed is:

1. A process for efficiently utilizing the heat output of a constant output nuclear reactor or fossil fuel furnace and boiler wherein boiler feed water is normally preheated by means of turbine extraction steam, in an electricity generating plant and enabling the plant to achieve flexible power output which comprises the steps of:

a. shunting a portion of extraction steam of various levels of expansion from the turbines to steam-oil heat exchangers during periods of low power demand;

b. shunting a portion of primary high pressure from the boiler to steam-oil heat exchangers during periods of low power demand;

c. moving a fluid low vapor pressure organic heat retention material from a cold storage location to a hot storage location through the heat exchangers of (a) and (b);

d. heating the fluid low vapor pressure organic heat retention material in the heat exchangers of (a) and (b) by means of said extraction steam and primary high pressure steam;

e. storing the hot low vapor pressure organic heat retention material at high temperature at atmospheric pressure in isolation from the atmosphere in a hot storage location;

f. during periods of peak power demand curtailing the boiler feed water preheating being performed by extraction steam;

g. moving the stored hot low vapor pressure organic heat retention material from hot storage to cold storage locations through oil-water heat exchangers;

h. heating boiler feed water in the oil-water heat exchangers of (g) by means of the moving hot low vapor pressure organic heat retention material;

i. passing the heated boiler feed water to the boiler.

2. The process of claim 1 further characterized by the steps of:

a. during periods of low power demand reheating turbine interstage steam by means of primary high pressure steam;

b. during periods of peak power demand curtailing the reheating of turbine interstage steam being performed by primary high pressure steam;

c. using stored hot vapor pressure organic heat retention material to reheat the turbine interstage steam before such hot low vapor pressure organic heat retention material is used to preheat the boiler feed water as in step (h).

3. The process according to claim 1 wherein the curtailing which occurs in step (f) consists of decreasing the boiler feed water preheating being performed by extraction steam.

4. The process according to claim 1 wherein the curtailing which occurs in step (f) consists of terminating the boiler feed water preheating being performed by extraction steam.

5. The process of claim 2 wherein the curtailing of which occurs in step (b) consists of decreasing the turbine interstage steam reheating being performed by primary high pressure steam.

6. The process of claim 2 wherein the curtailing which occurs in step (b) consists of terminating the turbine interstage steam reheating being performed by primary high pressure steam.

7. A process wherein a nuclear or fossil fuel power plant can be set up to instantaneously meet load demand which consists of the steps of extracting turbine steam during periods of low power demand transferring thermal energy from the steam to a low vapor pressure organic heat retention material and storing said material, channeling all steam to the turbines and terminating the extraction of turbine steam during peak power demand periods, simultaneously moving the stored hot low vapor pressure organic heat retention material from hot storage location means to cold storage location means while using said stored heat low vapor pressure organic heat retention material to perform the function of boiler feed water preheat and interstage steam reheat material thereby allowing the steam to fully expend itself in the turbine for the production of power.

8. The process of claim 1 further characterized in that (a) the heating of low vapor pressure organic heat retention material practiced in step (d) is to a temperature of about 525° F, and (b) the low vapor pressure organic heat retention material stored in step (g) after being used to heat boiler feed water in step (h) is stored at a temperature of about 100° F.

* * * * *